US012618657B2

(12) United States Patent
Petropoulos

(10) Patent No.: US 12,618,657 B2
(45) **Date of Patent: *May 5, 2026**

(54) EXPLOSIVE MATERIAL CHARGING DEVICE FOR CHARGING A BOREHOLE METHOD OF POSITIONING AN EXPLOSIVE MATERIAL CHARGING DEVICE EXPLOSIVE MATERIAL CHARGING VEHICLE AND DATA MEDIUM

(71) Applicant: LUOSSAVAARA-KIIRUNAVAARA AB, Luleå (SE)

(72) Inventor: Nikolaos Petropoulos, Luleå (SE)

(73) Assignee: Luossavaara-Kiirunavaara AB, Luleå (SE)

( * ) Notice: Subject to any disclaimer, the term of this patent is extended or adjusted under 35 U.S.C. 154(b) by 0 days.

This patent is subject to a terminal disclaimer.

(21) Appl. No.: 18/951,230

(22) Filed: Nov. 18, 2024

(65) Prior Publication Data

US 2025/0189286 A1 Jun. 12, 2025

Related U.S. Application Data

(63) Continuation of application No. 18/250,133, filed as application No. PCT/SE2021/051042 on Oct. 20, 2021, now Pat. No. 12,174,002.

(30) Foreign Application Priority Data

Oct. 22, 2020 (SE) ..... 2051234-9

(51) Int. Cl.
*F42D 1/10* (2006.01)
*F42B 3/087* (2006.01)
*F42D 1/22* (2006.01)

(52) U.S. Cl.
CPC ..... *F42D 1/10* (2013.01); *F42B 3/087* (2013.01); *F42D 1/22* (2013.01)

(58) Field of Classification Search
CPC ..... F42D 1/02; F42D 1/08; F42D 1/10; F42D 1/22; F42D 3/04; F42B 3/02; F42B 3/087; F42B 3/24; F42B 3/26
(Continued)

(56) References Cited

U.S. PATENT DOCUMENTS 473,734 A 4/1892 Forrester
1,842,664 A 1/1932 Elsing
(Continued)

FOREIGN PATENT DOCUMENTS

AU 2036999 A 9/1999
AU 2029402 A 9/2002
(Continued)

OTHER PUBLICATIONS

Aquise Cornejo Rutber, "Cut and fill, chambers and pillars: underground mining methods", https://www.gestiopolis.com/corte-y-relleno-camaras-y-pilares-metodos-demineriasubterranea/, Sep. 10, 2015.

(Continued)

*Primary Examiner* — James S Bergin
(74) *Attorney, Agent, or Firm* — Knobbe, Martens, Olson & Bear, LLP

(57) ABSTRACT

The present invention concerns an explosive material charging device and a method of positioning the explosive material charging device in a borehole. The explosive material charging device comprises a top anchor unit and a bottom anchor unit each configured to engage the borehole wall, an expandable tube member arranged between the top anchor unit and the bottom anchor unit and configured to be charged with explosive material, the bottom anchor unit comprises a backflow prevention valve device configured to prevent the explosive material to flow out from the expandable tube member, wherein the backflow prevention valve device is
(Continued)

openable for permitting a charging hose to enter the expandable tube member for reaching the interior of the top anchor unit.

17 Claims, 4 Drawing Sheets

(58) Field of Classification Search
USPC ..... 86/20.15; 102/313
See application file for complete search history.

(56) References Cited

U.S. PATENT DOCUMENTS 2,298,599 A 10/1942 Smith
2,536,869 A 1/1951 Bucky
3,068,654 A 12/1962 Warren
3,438,325 A 4/1969 Martin
3,508,407 A 4/1970 Booth
3,539,336 A 11/1970 Urich
3,615,351 A 10/1971 Happel et al.
3,635,456 A 1/1972 Anthes et al.
3,645,717 A 2/1972 Meyer et al.
3,673,807 A 7/1972 Serata
3,689,041 A 9/1972 Pere et al.
3,696,703 A * 10/1972 Fox ..... F42D 1/10 86/20.15
3,707,307 A 12/1972 Kristoffersson et al.
3,748,120 A 7/1973 Beggs et al.
3,779,741 A 12/1973 Celada et al.
3,897,107 A 7/1975 Haglund
3,939,771 A 2/1976 McReynolds
4,036,100 A * 7/1977 Hurley ..... F42D 1/10 166/207
4,040,329 A * 8/1977 Ljungberg ..... F42D 1/10 86/20.15
4,040,330 A * 8/1977 Matzen ..... F42D 1/10 102/304
4,060,034 A 11/1977 Bowman et al.
4,072,352 A 2/1978 Janelid
4,324,390 A 4/1982 Driemeyer
4,377,310 A 3/1983 Gubin et al.
4,501,199 A 2/1985 Mashimo et al.
4,522,125 A * 6/1985 Marz ..... F42D 1/10 299/13
4,581,712 A 4/1986 Perry et al.
4,592,282 A * 6/1986 Niemi ..... F42D 1/10 299/13
4,603,910 A 8/1986 Laneus
4,673,348 A 6/1987 Riley et al.
4,771,694 A 9/1988 Bartholomew
4,813,358 A * 3/1989 Roberts ..... F42D 1/08 102/323
4,829,902 A * 5/1989 Sharpe ..... F42D 1/10 86/20.13
4,845,940 A 7/1989 Beer
4,938,536 A 7/1990 Lee
5,007,683 A 4/1991 Granskog
5,192,819 A 3/1993 Baumgartner
5,198,613 A * 3/1993 Jenkins, Jr. ..... F42B 3/087 102/312
5,204,492 A 4/1993 Jacob
5,209,656 A 5/1993 Kobayashi et al.
5,267,850 A 12/1993 Kobayashi et al.
5,299,500 A 4/1994 Lindquist
5,437,707 A 8/1995 Cross
5,725,366 A 3/1998 Khinkis et al.
6,070,511 A * 6/2000 Palmer ..... F42D 1/10 299/13
6,123,394 A 9/2000 Jeffrey
6,132,489 A 10/2000 Villarreal-Trevino
6,395,056 B1 5/2002 Villarreal-Trevino et al.
6,397,754 B1 6/2002 Perlid
6,681,701 B2 1/2004 Perry
7,175,690 B2 2/2007 Potter et al.
8,381,653 B2 * 2/2013 Zimmermann ..... F42D 1/12 102/313
8,943,944 B2 2/2015 Zhang
9,062,953 B2 * 6/2015 Leppanen ..... F42D 1/04
9,243,879 B2 1/2016 Thomson
9,273,368 B2 3/2016 Gordon
10,502,727 B2 12/2019 Davis
10,570,736 B2 2/2020 Wang
10,793,928 B2 10/2020 Stroder et al.
12,174,002 B2 * 12/2024 Petropoulos ..... F42B 3/087
12,209,852 B2 * 1/2025 Petropoulos ..... F42D 1/18
2002/0197574 A1 12/2002 Jones et al.
2003/0148236 A1 8/2003 Joshi et al.
2005/0161257 A1 7/2005 Finden et al.
2007/0249204 A1 10/2007 Peterson
2009/0130617 A1 5/2009 Cain et al.
2012/0279353 A1 11/2012 Englund et al.
2012/0288810 A1 11/2012 Cain et al.
2014/0150607 A1 6/2014 Gordon
2015/0259760 A1 9/2015 Eder et al.
2015/0275323 A1 10/2015 Hoffman
2016/0061572 A1 3/2016 Eitschberger
2016/0304977 A1 10/2016 Kamikawa et al.
2017/0276344 A1 9/2017 Schreiner et al.
2018/0106584 A1 4/2018 Santos et al.
2019/0292887 A1 9/2019 Austin et al.
2020/0385827 A1 12/2020 Astoria et al.
2021/0095354 A1 4/2021 Bastow-Cox et al.
2022/0034504 A1 2/2022 Dombrowski et al.
2023/0203946 A1 6/2023 Wagner et al.
2023/0228193 A1 7/2023 Wagner et al.
2023/0400288 A1 * 12/2023 Petropoulos ..... F42B 3/26
2024/0124948 A1 4/2024 Eriksson et al.
2024/0279766 A1 8/2024 Sandberg et al.
2025/0051865 A1 2/2025 Lakdawala et al.
2025/0223660 A1 7/2025 Eriksson et al.
2025/0223661 A1 7/2025 Eriksson et al.
2025/0244116 A1 7/2025 Petropoulos

FOREIGN PATENT DOCUMENTS

AU 766127 B2 10/2003
AU 2002/233406 B2 10/2004
AU 785047 B2 9/2006
CA 703542 A 2/1965
CA 2793308 C * 9/2015 ..... F42B 3/087
CA 3176355 A1 11/2021
CN 1029333 C 7/1995
CN 203837589 U 9/2014
CN 105441670 A 3/2016
CN 108253850 A 7/2018
CN 108374067 A 8/2018
CN 106894817 B 11/2018
CN 110644997 A 1/2020
CN 210293005 U 4/2020
CN 111187871 A 5/2020
CN 114686633 A 7/2022
DE 2106062 A1 8/1971
EP 0018235 A1 10/1980
EP 1203188 A1 5/2002
EP 2000764 A1 * 12/2008 ..... F42D 3/04
EP 1017619 B1 6/2009
EP 2093300 B1 12/2012
EP 3222953 A1 9/2017
EP 3295084 B1 6/2020
EP 4032991 A1 7/2022
EP 4232773 A1 8/2023
GB 1439488 A 6/1976
GB 2532689 A 5/2016
GB 2577798 A 4/2020
JP S53-107683 U 8/1978
JP 2006/002193 A 1/2006
JP 2012102371 A 5/2012
KR 20100039491 A 4/2010
RU 2706994 C1 11/2019
SE 465566 B 9/1991
SE 2150180 A1 8/2022
SU 262127 A1 12/1977
WO WO 1995/030068 A1 11/1995

(56) References Cited

FOREIGN PATENT DOCUMENTS

| | | | |
|---|---|---|---|
| WO | WO 1998/41811 | A1 | 9/1998 |
| WO | WO 2001/004563 | A1 | 1/2001 |
| WO | WO 2008/148544 | A1 | 12/2008 |
| WO | WO 2011/038449 | A1 | 4/2011 |
| WO | WO 2011/100808 | A1 | 8/2011 |
| WO | WO 2011/117394 | A1 | 9/2011 |
| WO | WO 2014/109755 | A1 | 7/2014 |
| WO | WO 2017/214422 | A1 | 12/2017 |
| WO | WO 2019/219340 | A1 | 11/2019 |
| WO | WO 2020/039332 | A1 | 2/2020 |
| WO | WO 2020/245070 | A1 | 12/2020 |
| WO | WO 2021/183022 | A1 | 9/2021 |
| WO | WO 2021/241272 | A1 | 12/2021 |
| WO | WO 2021/250517 | A1 | 12/2021 |
| WO | WO 2022/086407 | A1 | 4/2022 |
| WO | WO 2022/129515 | A1 | 6/2022 |

OTHER PUBLICATIONS

Analysis of Induced Seismicity in the Rio Blanco Underground Mine, North Sector III Panel Areas 15, 16 and 17 Level 16 Collapsed Codelco Andina Division; Diego Romero Castro; Undergraduate thesis for the professional title of Geophysicist Concepción, Chile. Apr. 13, 2012: https://www.dgeo.udec.cl/wpcontent/uploads/2013/07/romero_diego_tesis.pdf.

Atlas Copco: "Mining methods in underground mining", Second Edition, Dec. 31, 2007, Retrieved from the Internet: URL:https://batavia.internal.epo.org/citenpl/prod/web/citenpl/citenpl.html.

Bhaskar et al., "Decarbonization of the Iron and Steel Industry with Direct Reduction of Iron Ore with Green Hydrogen", Energies, 2020, 13, 758, in 23 pages.

Harvey et al., "Greener reactants, renewable energies and environmental impact mitigation strategies in pyrometallurgical processes: A review", MRS Energy & Sustainability, Sep. 1, 2022, vol. 9, No. 2.

Hudyma et al., "Monitoring open stope caving at Goldex Mine", Proceedings of the Second International Symposium on Block and Sublevel Caving, Dec. 31, 2010, pp. 133-144.

Is there potential for Block Caving in the country? Institute of Mining Engineers, Aug. 16, 2013.

Manuel Enrique Aros Ulloa, "Stability of the production level in continuous mining", Thesis to Opt for the Title of Mining Civil Engineer, https://repositorio.uchile.cl/handle/2250/104852, University of Chile; Santiago de Chile, Oct. 2008.

Mehdi et al., "Investigation of Oxygen Injection Into the Pelletizing Furnace in Order to Quality Improve of Iron Ore Pellets", Proceedings of the 5th International Congress on the Science and Technology of Ironmaking, Oct. 20-22, 2009.

Mining Exploitation, https://www.ucursos.cl/ingenieria/2008/1/MI57E/1/material_docente/bajar?bajar=1&id=166065.

"Room and Pillar", 2016, https://es.slideshare.net/LuisnArmandoLenCndor1/mtodo-de-room-and-pilar-59787116.

Vennes et al., "Geomechanical effects of stress shadow created by large-scale destress blasting", Journal of Rock Mechanics and Geotechnical Engineering, 2017, vol. 9, pp. 1085-1093.

International Preliminary Report on Patentability for PCT/SE2021/051036 dated Nov. 17, 2022 in 30 pages.

International Preliminary Report on Patentability for PCT/SE2021/051040 dated Nov. 24, 2022 in 16 pages.

International Preliminary Report on Patentability for PCT/SE2021/051042 dated Nov. 17, 2022.

International Preliminary Report on Patentability for PCT/SE2022/050182 dated dated Feb. 8, 2023 in 35 pages.

International Preliminary Report on Patentability for PCT/SE2022/050557 dated Apr. 20, 2023 in 14 pages.

International Preliminary Report on Patentability in International Application No. PCT/SE2021/050475 dated Apr. 22, 2022 in 6 pages.

International Preliminary Report on Patentability in International Application No. PCT/SE2021/050477 dated Apr. 21, 2022 in 5 pages.

International Preliminary Report on Patentability received in International Application No. PCT/SE2023/050839, mailed Nov. 26, 2024, in 12 pages.

International Preliminary Report on Patentability received in International Application No. PCT/SE2023/050891, mailed Jan. 3, 2025.

International Search Report / Written Opinion of International Searching Authority for PCT/SE2021/051036 dated Nov. 1, 2021 in 11 pages.

International Search Report and Written Opinion in International Application No. PCT/SE2021/050475 dated Jun. 23, 2021 in 13 pages.

International Search Report and Written Opinion issued in International Application No. PCT/SE2022/050557 dated Jun. 16, 2022 in 14 pages.

International Search Report and Written Opinion issued in International Application No. PCT/SE2022/051197, mailed on Jan. 23, 2023.

International Search Report and Written Opinion issued in International PCT Application No. PCT/SE2021/051040 dated Nov. 10, 2021 in 12 pages.

International Search Report and Written Opinion of the International Searching Authority for PCT/SE2021/051042 dated Nov. 1, 2021.

International Search Report and Written Opinion of the International Searching Authority for PCT/SE2022/050182 dated May 20, 2022 in 16 pages.

International Search Report and Written Opinion received in International Application No. PCT/SE2023/050293, mailed Jun. 14, 2023.

International Search Report and Written Opinion received in International Application No. PCT/SE2023/050298, mailed Jun. 7, 2023.

International Search Report and Written Opinion received in International Application No. PCT/SE2023/050830, mailed Oct. 19, 2023.

International Search Report and Written Opinion received in International Application No. PCT/SE2023/050825, mailed Oct. 30, 2023.

International Search Report and Written Opinion received in International Application No. PCT/SE2023/050839, mailed Oct. 19, 2023.

International Search Report and Written Opinion received in International Application No. PCT/SE2023/050891, mailed Dec. 8, 2023.

International Search Report received in International Application No. PCT/SE2023/050837, mailed Oct. 17, 2023.

International Search Report in International Application No. PCT/SE2021/050477 dated Jun. 23, 2021 in 5 pages.

Written Opinion received in International Application No. PCT/SE2023/050837, mailed Apr. 7, 2024.

* cited by examiner

EXPLOSIVE MATERIAL CHARGING DEVICE FOR CHARGING A BOREHOLE METHOD OF POSITIONING AN EXPLOSIVE MATERIAL CHARGING DEVICE EXPLOSIVE MATERIAL CHARGING VEHICLE AND DATA MEDIUM

TECHNICAL FIELD

The present invention relates to an explosive material charging device according to claim 1 and to a method of preparing an explosive material charging device according to claim 8.

The present invention primary concerns the mining industry making use of explosive material charging devices and applying methods related to the preparation of explosive material charging devices.

The present invention also concerns the industry manufacturing explosive material charging devices.

BACKGROUND

In some locations of underground mines, large amount of water drains from drilled boreholes. This water may originate from the drilling operation or from ground water permeable rocks and spaces. Lots of water may stream into the borehole from cracks or cavities in contact with the borehole.

In such environment, the borehole wall of the drilled borehole is covered by a thick film of water, or may even be filled with water flowing from the borehole and from cavities in the borehole.

A borehole with large amount of water, and which may have wet cracks and cavities, involves that the explosive material would not have enough adhesion with the borehole wall. It may also be critical that cavities and cracks of the borehole rule out that precise and well-defined amount of explosive material can be charged into the borehole.

In current charging operations, due to the poor adhesion and high water pressure, the explosive material may flow out from the borehole and splashes onto the crosscut floor of the mine. The consequences of the splashes are many, e.g. dangerous working environment due to explosive material covering the entire crosscut floor, nitrogen contamination and other chemical contamination of the ground water, clogged water pumps, etc.

In explosive material charging operations, making use of explosive material charging devices, the boreholes are drilled in the rock, and subsequently the explosive material is charged into the boreholes by means of a charging hose. The explosive material in the borehole is initiated by means of a detonator unit arranged in a detonator unit support, wherein the explosive material is initiated into detonation causing fragmentation of the rock.

Current explosive material charging devices and methods of preparing explosive material charging devices configured for explosive material charging in such types of boreholes may use various types of plugs and cartridges for holding the explosive material in the wet borehole.

However, prior art explosive material charging devices are time consuming to use in such boreholes.

The prior art plugs and cartridges may be pushed out from the wet borehole due to high water pressure building up in the borehole above the plug or cartridge. The high water pressure thus affects the plug or cartridge with a force from above together with the weight of the explosive material.

Prior art explosive material charging devices do not take into account eventual cracks or cavities entering the borehole wall of the borehole to be charged, wherein inexact amount of explosive material is used.

The borehole generally has a vertical direction. However, the borehole may have different directions, such as generally horizontal or oblique directions.

SUMMARY OF THE INVENTION

There is an object to provide an explosive material charging device configured for explosive material charging in a wet borehole.

There is an object to provide an explosive material charging device that is easy and secure to handle and that at the same time provides sustainable initiating of the explosive material.

There is an object to provide an explosive material charging device that safely keeps or holds the explosive material in the borehole.

There is an object to provide an explosive material charging device that promotes that a well-defined amount and/or exact amount of explosive material can be charged in the borehole.

There is an object to provide an explosive material charging device that is cost-effective and time saving to use.

There is an object to provide an explosive material charging device that is flexible and adjustable for different types of boreholes and for different lengths of boreholes. There is an object to provide an explosive material charging device of light weight.

There is an object to provide an explosive material charging device that can be applied by a charging truck also used for charging explosive material in dry boreholes.

There is an object to provide an explosive material charging device that promotes secure blasting and initiating of the explosive material.

There is an object to provide a compact explosive material charging device.

There is an object to provide an explosive material charging device of a blasting system that can be put into use in a flexible blasting system configured to be charged in a borehole of a mine.

There is an object to provide a first explosive material charging device that can be combined with a second explosive material charging device of a blasting system.

There is an object to provide a first explosive material charging device that can be combined with a second explosive material charging device of a blasting system.

This or at least one of said objects has been achieved by an explosive material charging device configured for explosive material charging in a borehole, the explosive material charging device comprises; a top anchor unit and a bottom anchor unit each configured to engage the borehole wall, an expandable tube member arranged between the top anchor unit and the bottom anchor unit and configured to be charged with explosive material, the bottom anchor unit comprises a backflow prevention valve device configured to prevent the explosive material to flow out from the expandable tube member, wherein the backflow prevention valve device is openable for permitting a charging hose to enter the expandable tube member for reaching the interior of the top anchor unit.

In such a way is achieved an explosive material charging device increasing safety and efficiency in a mine.

Alternatively, the centre axis of the first main body and centre axis of the second main body are co-linear with each other and with the centre axis of the expandable tube member, when the explosive material charging device has been inserted into the borehole.

Alternatively, the expandable tube member is made of a flexible material and is configured to expand in longitudinal direction along the centre axis and is configured to be compressed in longitudinal direction.

Alternatively, the top anchor unit is above the bottom anchor unit when the explosive material charging device is positioned in a borehole. Alternatively, the expandable tube member is configured to isolate the explosive material from water in the borehole.

Alternatively, the top anchor unit comprises a first radially outward extending resilient device configured to engage the borehole wall for holding the top anchor unit in position in the borehole.

Alternatively, the bottom anchor unit comprises a second radially outward extending resilient device configured to engage the borehole wall for holding the bottom anchor unit in position in the borehole.

Alternatively, the first and second radially outward extending resilient portion extend circumferentially around the respective top anchor unit and bottom anchor unit, and each portion comprises at least one open space configured to permit the water in the borehole to stream past the exterior of the expandable tube member.

Alternatively, the top anchor unit comprises a first main body extending along a centre axis, which has an orientation extending along the prolongation of the borehole when the explosive material charging device has been inserted into the borehole.

Alternatively, the bottom anchor unit comprises a second main body extending along a centre axis, which has an orientation extending along the prolongation of the borehole when the explosive material charging device has been inserted into the borehole.

Alternatively, a lower portion of the first main body comprises a first end of the first main body and an upper portion of the first main body comprises a second end of the first main body.

Alternatively, the first end of the first main body faces the second main body.

Alternatively, a lower portion of the second main body comprises a first end of the second main body and an upper portion of the second main body comprises a second end of the second main body.

Alternatively, the first end of the second main body faces the borehole entrance when the explosive material charging device is position in the borehole.

Alternatively, a second end of the first main body is opposite the first end of the first main body and faces the borehole bottom when the explosive material charging device is position in the borehole.

Alternatively, a second end of the second main body is opposite the first end of the second main body and faces the first main body when explosive material charging device is position in the borehole. Alternatively, the first and/or second radially outward extending resilient device/-s having a sloping outward extension relative the centre line of 30-70 degrees, preferably 45-60 degrees, and declining toward the first end.

Alternatively, the top anchor unit comprises at least two radially outward extending resilient devices configured to engage the borehole wall for holding the top anchor unit in position in the borehole.

Alternatively, the bottom anchor unit comprises at least two radially outward extending resilient devices configured to engage the borehole wall for holding the bottom anchor unit in position in the borehole.

Alternatively, the explosive material charging device comprises a detonator unit support configured to carry a detonator unit.

Alternatively, the bottom anchor unit comprises the detonator unit support.

Alternatively, a front end of a charging hose nozzle of the charging hose is configured to abut in engagement with an abutment surface of the interior of the top anchor unit.

Alternatively, the motion of the charging hose moves the explosive material charging device in the borehole by the engagement with the abutment surface.

Alternatively, the motion of the charging hose is stopped when the expandable tube member is expanded and the explosive material charging device has been moved into a desired position in the borehole.

Alternatively, an explosive material discharge pump coupled to the charging hose is configured to feed the explosive material to the charging hose nozzle configured to discharge the explosive material into the interior of the expandable tube member.

Alternatively, the charging hose nozzle is positioned at any position in the interior of the expandable tube member between the top anchor unit and the bottom anchor unit to discharge the explosive material into the interior of the expandable tube member.

Alternatively, the charging hose nozzle is positioned in the top anchor unit to discharge the explosive material into the interior of the expandable tube member.

In such way is achieved time saving operation as the discharge of explosive material immediately after the stop of pushing the explosive material charging device in the bore hole. Alternatively, the backflow prevention valve device is configured to close when the charging hose nozzle exits from the interior of the expandable tube member and leaves the flap member of the backflow prevention valve.

Alternatively, the flap member is spring biased toward its closed state when the charging hose nozzle is leaving the backflow prevention valve device.

Alternatively, the charging hose nozzle of the charging hose is configured for withdrawal from the expandable tube member and from the backflow prevention valve.

Alternatively, the backflow prevention valve is configured to close a flap member of the backflow prevention valve subsequently the charging hose nozzle has been withdrawn from the backflow prevention valve.

Alternatively, the backflow prevention valve device is configured to close when the charging hose nozzle exits from the interior of the expandable tube member and leaves the flap member of the backflow prevention valve due to the spring biased flap member otherwise resting on the charging hose or charging hose nozzle.

Alternatively, the backflow prevention valve device configured to prevent discharged explosive material discharged from the charging hose to flow back into the borehole beneath the explosive material charging device when the charging hose has been removed from the opening.

Alternatively, the flap member is spring biased toward its closed state when the charging hose nozzle leaves the backflow prevention valve device.

Alternatively, the flap member is spring biased to its closed state for providing said closing preventing the explosive material in the expandable tube member and discharged above the backflow prevention valve to stream downward into the borehole beneath the explosive material charging device.

Alternatively, the flap member is hingedly coupled to a channel wall of a channel of the second main body.

Alternatively, the channel is configured to receive and permit passage of the charging hose nozzle.

Alternatively, the flap member is arranged at the first end of the second main body.

Alternatively, the flap member is openable in a direction toward the second end of the second main body, thus configured to be opened by the charging hose nozzle moved upward. Alternatively, the channel is configured to receive the explosive material above the closed flap member.

Alternatively, the channel is oriented along a centre line of the explosive material charging device extending along the borehole extension during said explosive material charging.

Alternatively, there is provided a blasting system configured for explosive material charging in a borehole, wherein the blasting system comprises a first explosive material charging device and a second explosive material charging device which are positioned on top of each other in the borehole, Alternatively, the top anchor unit of the first explosive material charging device exteriorly is formed as a truncated cone configured to fit a cone shaped cavity of a bottom anchor unit of the second explosive material charging device positioned on top of the first explosive material charging device.

Alternatively, an engagement force of the radially outward extending resilient portion generates sufficient friction, between the borehole wall and the outer ends of the radially outward extending resilient portion, resisting motion of the second main body relative the borehole so that the expandable tube member is expanded by moving the charging hose in contact with the abutment surface of the interior of the first main body.

Alternatively, an engagement force between the borehole wall and the radially outward extending resilient portions of the explosive material charging device is provided to resist gravity force of explosive material, and thus holding the explosive material charging device in the borehole at the same time as the water can flow through the open spaces of the radially outward extending resilient portions.

Alternatively, the borehole generally extends vertically.

Alternatively, the borehole generally may extend oblique.

Alternatively, the borehole comprises a borehole entrance and a borehole bottom, Alternatively, the borehole entrance is below the borehole bottom.

Alternatively, the charging hose is moved by an electrical motor of a mining truck.

Alternatively, the detonator unit support is configured as a detonator unit compartment having a prolongation extending parallel with the prolongation of said channel and is provided adjacent the channel and exhibits an compartment opening facing the borehole entrance when the explosive material charging device is positioned in the borehole.

Alternatively, the detonator unit compartment is configured to enclose the detonator unit. Alternatively, the detonator unit compartment comprises a detonator unit latching mechanism configured to hold the detonator unit in the detonator unit compartment.

Alternatively, a detonation cord member, such as a shock tube or detonation cord, is coupled to the detonator unit and runs from the detonator unit positioned in the detonator unit compartment.

By collecting the explosive material also in the channel, the detonator unit positioned in the detonator unit compartment adjacent the channel will come close to the explosive material promoting secure blasting.

Alternatively, the first radially outward extending resilient device comprises a ring-shaped rim extending around the centre axis, and comprises at least one cavity configured to permit water to pass and/or the rim being formed with tooth shaped flaps arranged along a circumference of the top anchor unit and around the centre line.

Alternatively, the second radially outward extending resilient device comprises a ring-shaped rim extending around the centre axis, and comprises at least one cavity configured to permit water to pass and/or the rim being formed with tooth shaped flaps arranged along a circumference of the bottom anchor unit and around the centre line.

Alternatively, outer ends of the tooth shaped flaps are configured to engage the borehole wall.

Alternatively, the tooth shaped flaps are arranged at a periphery of the first main body and circumferentially around the first main body, preferably arranged along a circumference circulating the centre line.

Alternatively, the tooth shaped flaps are arranged at a periphery of the second main body and circumferentially around the second main body, preferably arranged along a circumference circulating the centre line.

Alternatively, the first radially outward extending resilient device runs around the first main body in the peripheral direction coaxially with the centre axis.

Alternatively, the second radially outward extending resilient device runs around the second main body in the peripheral direction coaxially with the centre axis.

Alternatively, the respective radially outward extending resilient device runs discontinuously around the first and second main body.

Alternatively, the respective radially outward extending resilient device is made of flexible resilient material and is adapted to engage the borehole wall of the borehole and/or biased into secure engagement with the borehole wall.

Alternatively, the respective radially outward extending resilient device is tooth shaped with open spaces there between.

Alternatively, the respective first and second radially outward extending resilient device comprises at least one open space.

In such way is achieved that water is permitted to pass the exterior of the first and second main body and between the borehole wall and the outer peripheral surface of the explosive material charging device thus passing through the at least one open space.

In such way is avoided that water pressure is built up above the first and/or second main body, which water pressure otherwise may press out the explosive material charging device from the borehole.

Alternatively, the respective radially outward extending resilient device exhibits tooth shaped flaps and/or teeth, each having a sloping outward extension relative the main body centre line of 30-70 degrees, preferably 45-60 degrees, and declining toward the first end.

Alternatively, a net member or other suitable filter member is arranged covering the open space/-s of the respective radially outward extending resilient device.

In such a way is achieved that gravel and sand, but primarily water will pass through the first and/or second radially outward extending resilient device/devices or between the first and/or second radially outward extending resilient device/devices of the top anchor unit and/or the bottom anchor unit.

Alternatively, the respective radially outward extending resilient device allows resilient deformation of the resilient member upon insertion of the first and second main body into the borehole, thereby engaging the borehole wall.

Alternatively, the respective radially outward extending resilient device arranged on the outer peripheral surface of the top and/or bottom anchor unit may comprise at least one open space through which the water stream streaming along the borehole wall will drain.

Alternatively, the top anchor unit is configured to be pushed in the borehole by that a charging hose nozzle of the charging hose is adapted to abut an abutment surface of the top anchor unit, wherein the force of friction between the radially outward extending resilient device of the bottom anchor and the borehole wall constrains the motion of the bottom anchor unit and provides longitudinal expansion of the expandable tube, whereas the top anchor unit being pushed by the charging hose.

In such way is secure engagement achieved between the explosive material charging device and the borehole wall.

Alternatively, the method comprises a step defined as stop moving the charging hose.

Alternatively, the method comprises a step defined as discharging of explosive material from the charging hose nozzle into the borehole above the main body of the detonator support.

Alternatively, the method comprises a step defined as stopping the discharge of explosive material.

Alternatively, the method comprises a step defined as withdrawal of the charging hose from the borehole.

Alternatively, the method comprises a step defined as stopping the method.

A borehole may be defined as a wet borehole having a borehole wall that is partly or fully is covered by a water film. The thickness of the water film may be 0, 1-1, 1 mm or larger.

The water film may originate from the drilling of the borehole (added water or other cooling fluid for cooling the bore) or groundwater.

The water film may comprise also any type of cooling fluid for cooling the drill.

This or at least one of said objects has been achieved by a method of positioning (or preparing) an explosive material charging device (configured for explosive material charging) in a borehole, the explosive material charging device comprises; a top anchor unit and a bottom anchor unit configured to engage the borehole wall, an expandable tube member arranged between the top anchor unit and the bottom anchor unit and configured to be charged with explosive material, the bottom anchor unit comprises a backflow prevention valve device configured to prevent the explosive material to flow out from the expandable tube member, wherein the backflow prevention valve device is openable for permitting a charging hose to enter the expandable tube member for reaching the interior of the top anchor unit, the explosive material charging device comprises a detonator unit support configured to carry a detonator unit, wherein the method comprises the steps of; providing the explosive material charging device, wherein the expandable tube member is held in compressed state by means of a holding member; mounting the detonator unit to the detonator unit support; inserting the charging hose into the interior of the expandable tube member via the backflow prevention valve device; moving the charging hose until it abuts an abutment surface of the interior of the top anchor unit; releasing the holding member so that the expandable tube member is free to expand; pushing the top anchor unit in the borehole by means of the charging hose abutting the abutment surface, wherein the force of friction between the bottom anchor and the borehole provides longitudinal expansion of the expandable tube member; stop pushing the top anchor unit wherein the explosive material charging device is in desired position in the borehole; discharging the explosive material into the expanded expandable tube member by means of the charging hose; removing the charging hose from the expandable tube member.

Alternatively, the step of removing the charging hose comprises withdrawing the charging hose from the backflow prevention valve device.

Alternatively, the method comprises the further step of providing a second explosive material charging device, wherein a second expandable tube member of the second explosive material charging device is held in compressed state between a second top anchor unit and a second bottom anchor unit of the second explosive material charging device by means of a second holding member; mounting a second detonator unit to a second detonator unit support of the second explosive material charging device; inserting the charging hose into the interior of the second expandable tube member via a second backflow prevention valve device of the second bottom anchor unit; moving the charging hose until it abuts a second abutment surface of the interior of the second top anchor unit; releasing the second holding member so that the second expandable tube member is free to expand; pushing the second top anchor unit in the borehole by means of the charging hose abutting the second abutment surface, wherein the force of friction between the second bottom anchor and the second borehole provides longitudinal expansion of the second expandable tube member; stop pushing the second top anchor unit when the second explosive material charging device is in desired position in the borehole and/or abuts an already charged first explosive material charging device above the second explosive material charging device; and discharging the explosive material into the second expanded expandable tube member by means of the charging hose; removing the charging hose from the second expandable tube member.

Alternatively, the already charged first explosive material charging device is charged with explosive material and corresponds with the design of the second explosive material charging device and exemplary embodiments of the herein disclosed explosive material charging device.

Alternatively, the first explosive material charging device may be called explosive material charging device.

This or at least one of said objects has been achieved by an autonomous or semi-automatic explosive material charging vehicle configured to charge any exemplary explosive material charging device herein disclosed which autonomous or semi-automatic explosive material charging vehicle comprises a robotic arm and a charging hose feeder), which are coupled to a control circuitry configured to control any exemplary method herein disclosed.

This or at least one of said objects has been achieved by a data medium, configured for storing a program, adapted for controlling the charging of the explosive material charging device by means of said autonomous or semi-automatic explosive material charging vehicle, wherein said data medium comprises a program code stored on the data medium, which program code is readable on the control circuitry of the autonomous or semi-automatic explosive material charging vehicle for performing any exemplary method herein disclosed.

This or at least one of said objects has been achieved by a data medium product comprising a program code stored on a data medium, which program code is readable on the control circuitry (50) for performing any exemplary method steps herein disclosed, when said data medium is run on the control circuitry.

Alternatively, the expandable tube member comprises resilient material.

Alternatively, the expandable tube member comprises a flexible metal protection conduit consisting of folded metal sheet.

Alternatively, the expandable tube member is made rubber and/or plastic.

Alternatively, the explosive material charging device may comprise the charging hose.

Alternatively, the expandable tube member comprises waterproof fabric.

BRIEF DESCRIPTION OF THE DRAWINGS

The present invention will now be described by way of examples with references to the accompanying schematic drawings, of which.

DETAILED DESCRIPTION

Hereinafter, exemplary embodiments of the present invention will be described with reference to the accompanying drawings, wherein for the sake of clarity and understanding of the invention some details of no importance may be deleted from the drawings.

Figure 1A:
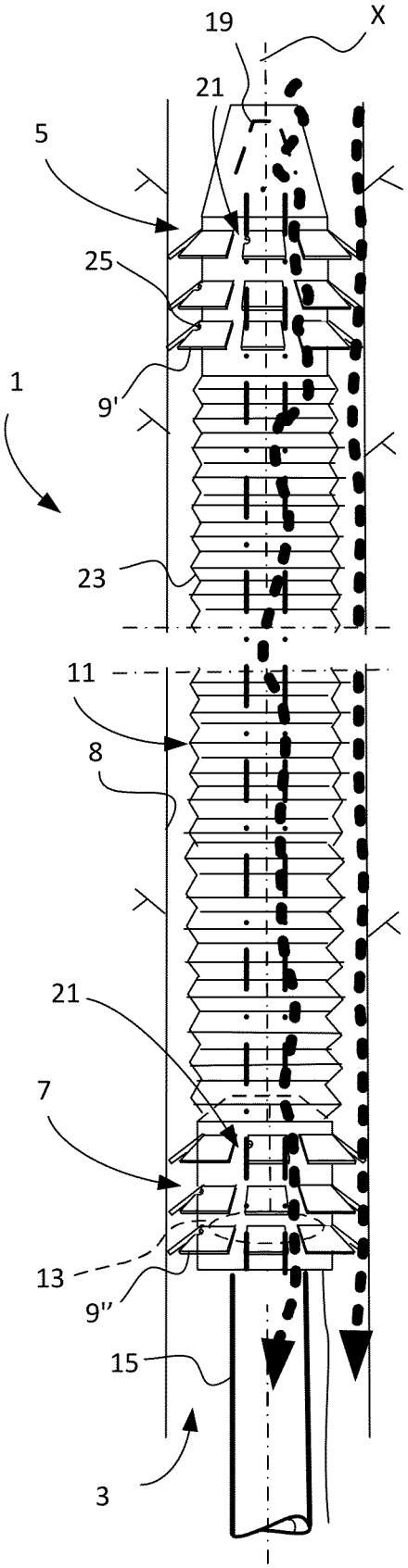
FIGS. 1*a*-1*c* illustrate an explosive material charging device according to a first example.
Figure 1B:
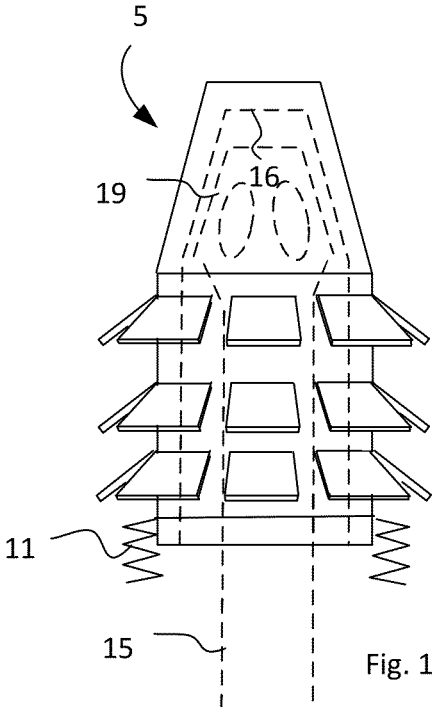
Figure 1C:
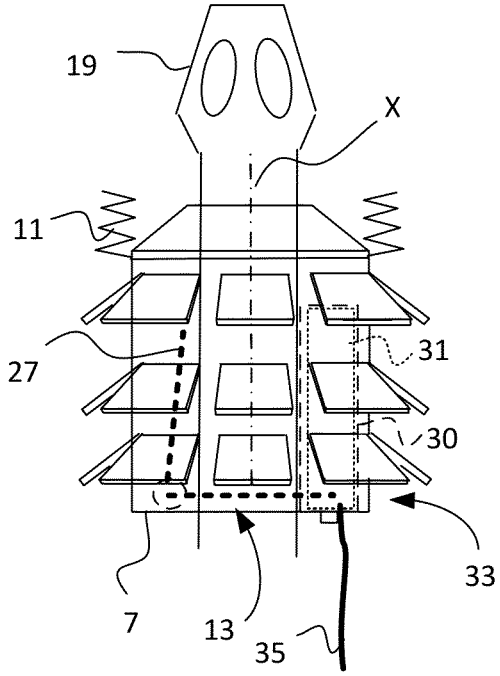

FIGS. 1*a*-1*c* illustrate an explosive material charging device 1 according to a first example. FIG. 1*a* shows, in a side view, the explosive material charging device 1 configured for explosive material charging in a borehole 3.

The explosive material charging device 1 comprises a top anchor unit 5 and a bottom anchor unit 7. The top anchor unit 5 is configured to engage a borehole wall 8 of the borehole 3 by means of a first radially outward extending resilient teeth shaped flaps 9' configured to engage the borehole wall 8 for holding the top anchor unit 5 in position in the borehole 3. The bottom anchor unit 7 is configured to engage a borehole wall 8 by means of second radially outward extending resilient teeth shaped flaps 9" configured to engage the borehole wall 8 for holding the bottom anchor unit 7 in position in the borehole 3.

The explosive material charging device 1 further comprises an expandable tube 11 arranged between the top anchor unit 5 and the bottom anchor unit 7. The expandable tube 11 is configured to be charged with explosive material (not shown) by means of a charging hose 15.

A backflow prevention valve 13 of the bottom anchor unit 7 is openable permitting the charging hose 15 to enter the expandable tube 11 for reaching the interior of the top anchor unit 5 and/or an abutment surface 16 (See FIG. 1*b*) of the interior of the top anchor unit 5. The top anchor unit 5 is pushed in the borehole 3 by that a charging hose nozzle 19 of the charging hose 15 abuts the abutment surface 16, wherein the force of friction between the second radially outward extending resilient teeth shaped flaps 9" of the bottom anchor 7 and the borehole wall 8 constrains the motion of the bottom anchor unit 7 and provides longitudinal expansion of the expandable tube 11, whereas the top anchor unit 5 being pushed by the charging hose 15.

The backflow prevention valve 13 is further configured to prevent the explosive material to flow out from the expandable tube 11. The backflow prevention valve 13 is configured to prevent the explosive material to flow out from the expandable tube 11 when the charging hose 15 and the charging hose nozzle 19 have been withdrawn from the explosive material charging device 1 by the absence of the charging hose 15, wherein a valve flap of the backflow prevention valve 13 is spring biased toward a closed state.

The first 9' and second 9" radially outward extending resilient teeth shaped flaps are made of flexible material and exhibit open spaces 21 there between.

In such way is achieved that water is permitted to pass the exterior of the expandable tube 11, thus between the borehole wall 8 and an outer peripheral surface 23 of the expandable tube 11 and passing through the open spaces 21. In such way is avoided that high water pressure would be built up above the explosive material charging device 1. The water pressure otherwise would otherwise press out the explosive material charging device 1 from the borehole. The provision of collecting/discharging the explosive material in the expandable tube 11, there is provided that the explosive material does not vanish into cracks or cavities facing the borehole 3.

The first 9' and second radially outward extending resilient teeth shaped flaps 9" may be formed with notches 25 configured to guide and protect a shock tube and/or a detonation cord (not shown) running from an explosive material charging device (not shown) positioned above the explosive material charging device 1.

The expandable tube 11 is made of a flexible material and is configured to expand in longitudinal direction and is configured to be compressed in longitudinal direction.

A centre axis X of the top anchor unit 5 and a centre axis of the bottom anchor unit 7 are co-linear with each other and with a centre axis X of the expandable tube 11, when the explosive material charging device 1 has been inserted into the borehole 3.

The expandable tube 11 is made of a flexible material and is configured to expand in longitudinal direction and is configured to be compressed in longitudinal direction.

The expandable tube 11 is configured to isolate the explosive material from water in the borehole. FIG. 1*b* shows the top anchor unit 5 in detail. A charging hose nozzle 19 of the charging hose 15 is configured to enter the expandable tube 11 for reaching an abutment surface 16 of the top anchor unit 5 for providing said pushing and expanding of the explosive material charging device 1 in the borehole.

FIG. 1*c* shows the bottom anchor unit 7 in detail. The backflow prevention valve 13 of the bottom anchor unit 7 comprises a valve flap 27. The backflow prevention valve 13 is opened by pushing the charging hose nozzle 19 in engagement with the spring biased valve flap 27. The charging hose nozzle 19 enters the interior of the expandable tube 11 for reaching the abutment surface 16 (See FIG. 1*b*).

Subsequently discharging the explosive material into the expandable tube 11 and withdrawal of the charging hose nozzle 19 from the backflow prevention valve 13, thus closing the spring biased valve flap 27 into a closed state, will prevent the explosive material to flow out from the expandable tube 11.

The bottom anchor unit 7 of the explosive material charging device 1 comprises a detonator unit support compartment 30 configured to carry a detonator unit 31. A lock 32 arranged at a lower portion 33 of the bottom anchor unit 7. A detonator cord 35 is mounted to the detonator unit 31.

Figure 2:
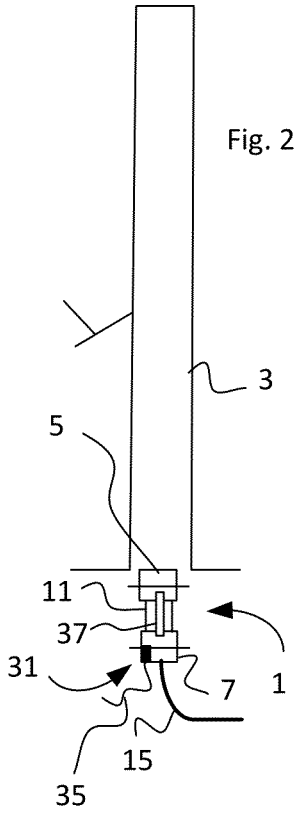
FIGS. 2-7 illustrate charging of explosive material by means of an explosive material charging device according to a second example into a wet borehole.

FIGS. 2-7 illustrate charging of explosive material by means of an explosive material charging device 1 according to a second example into a wet borehole 3. FIG. 2 shows an expandable tube 11 of the explosive material charging device 1 is held in compressed state between a top anchor unit 5 and a bottom anchor unit 7 of the explosive material charging device 1 by means of a releasable holding strap 37. A detonator unit 31 is applied to the bottom anchor unit 7. A charging hose nozzle of a charging hose 15 is inserted into the explosive material charging device 1. A detonator cord 35 is mounted to a detonator unit 31.

Figure 3:
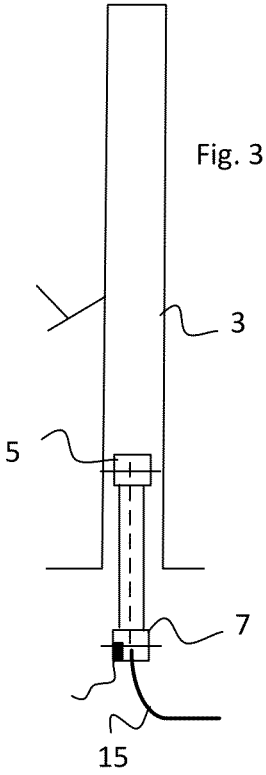
Figure 4:
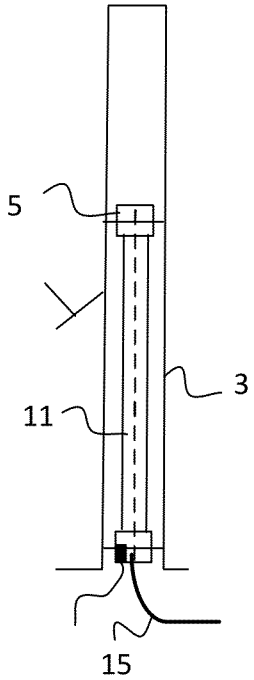
Figure 5:
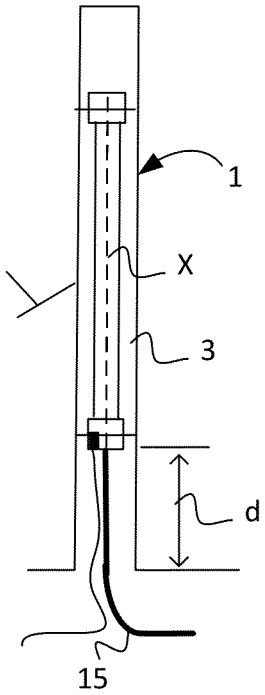

FIG. 3 shows that the releasable holding strap 37 shown in FIG. 2 has been released whereby the expandable tube 11 is free to expand. The charging hose nozzle of a charging hose 15 is moved into engagement with the top anchor unit 5. The top anchor unit 5 is inserted into the borehole 3 and pushed some distance upward in the borehole 3. Subsequently, the bottom anchor unit 7 is also inserted into the borehole, as shown in FIG. 4. The top anchor unit 5 is pushed further upward by means of the charging hose 15, whereas the expandable tube is fully expanded and the entire expanded explosive material charging device 1 is moved a further distance and stops at a position corresponding with a predetermined distance d from the borehole entrance, as shown in FIG. 5. This can be accomplished by means of markings on the charging hose 15 or by means of a line stopping arrangement (not shown). A centre axis X of the top anchor unit 5 and a centre axis of the bottom anchor unit 7 are co-linear with each other and with a centre axis X of the expandable tube 11, when the explosive material charging device 1 has been inserted into the borehole 3.

Figure 6:
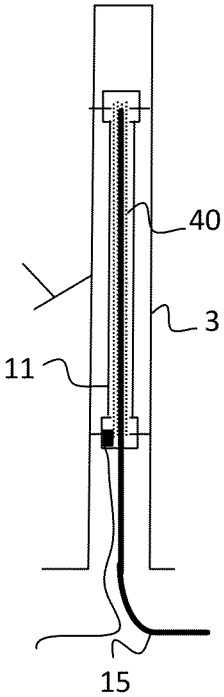
Figure 7:
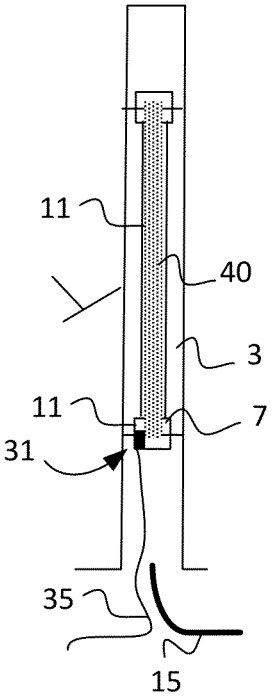

Subsequently an explosive material 40 is discharged from the charging hose nozzle of a charging hose 15 into the interior of the expanded expandable tube 11 as shown in FIG. 6. Afterwards, in FIG. 7, the charging hose 15 is removed from the explosive material charging device 1. A backflow prevention valve (not shown) of the bottom anchor unit 7 hinders the explosive material to exit the interior of the expandable tube 11 and hinders the explosive material to flow downward. The explosive material is isolated from coming into contact with water (not shown) flowing in the borehole 3 and is unable to vanish into eventual cavities of the borehole 3 in undesired and uncontrolled manner. The explosive material is held by the explosive material charging device 1 in a controlled manner as shown in FIG. 7. The detonator cord 35 is coupled to an initiator unit (not shown).

Figure 8:
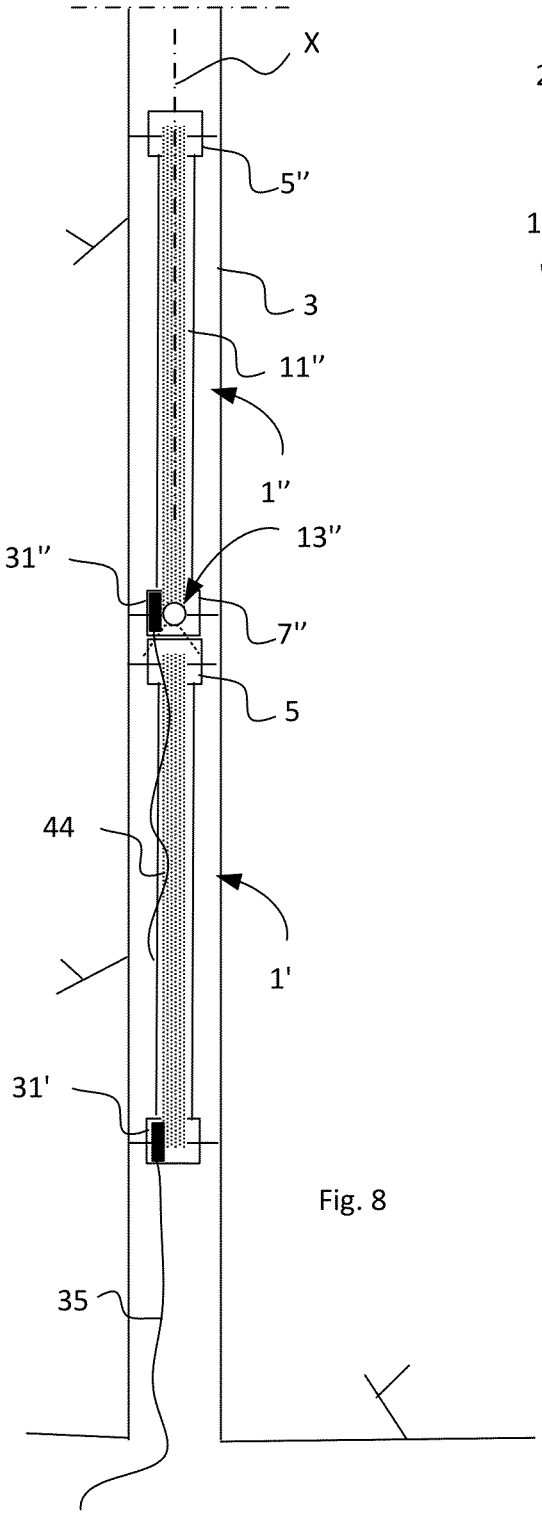
FIG. 8 illustrates a first explosive material charging device combined with a second explosive material charging device according to a third example.

FIG. 8 illustrates a first explosive material charging device 1' combined with a second explosive material charging device 1" according to a third example. The blasting system in FIG. 8 is configured for explosive material charging in a long borehole 3. The blasting system may comprise even further explosive material charging devices positioned above the first 1' and second 1" explosive material charging devices. The first explosive material charging device 1' and the second explosive material charging device 1" are positioned on top of each other. A top anchor unit 5 of the first explosive material charging device 1' exteriorly may be formed as a truncated cone configured to fit a cone shaped cavity of a second bottom anchor unit 7" of the second explosive material charging device 1" for establishing proper contact between the first explosive material charging device 1' and the second explosive material charging device 1". A shock tube 44 is mounted to a detonator unit 31" of the a bottom anchor unit 7 of the second explosive material charging device 1", which shock tube 44 runs adjacent the expanded expandable tube 11 of the first explosive material charging device 1'. A detonator cord 35 mounted to a detonator unit 31' is coupled to a remote blast initiator (not shown). The second explosive material charging device 1" comprises a second expandable tube member 11". The charging hose is inserted into the interior of the second expandable tube member 11" via a second backflow prevention valve device 13" of the second bottom anchor unit 7". The charging hose is moved until it abuts a second abutment surface of the interior of the second top anchor unit 5".

Figure 9A:
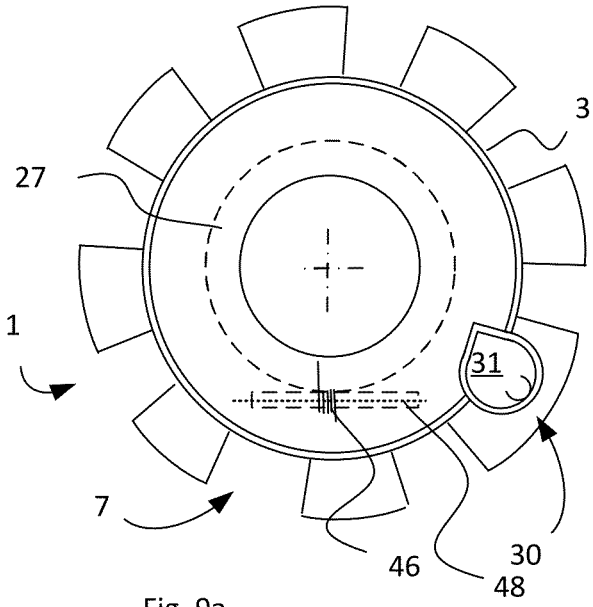
FIGS. 9*a*-9*b* illustrate further exemplary explosive material charging devices.

FIG. 9*a* illustrates in a view from below a bottom anchor unit 7 of an explosive material charging device 1 according to a further example. The bottom anchor unit 7 comprises a flap valve 27 that is spring biased to closed position be means of a spring 46 arranged around a hinge 48 about which the flap valve 27 pivots. The bottom anchor unit 7 further comprises a detonator unit support compartment 30 configured to carry a detonator unit 31. The detonator unit support compartment 30 exhibits a cross-section that is non-circular corresponding with the cross-section of the detonator unit 31 for providing a fixed position and hinder rotation of the detonator unit 31.

Figure 9B:
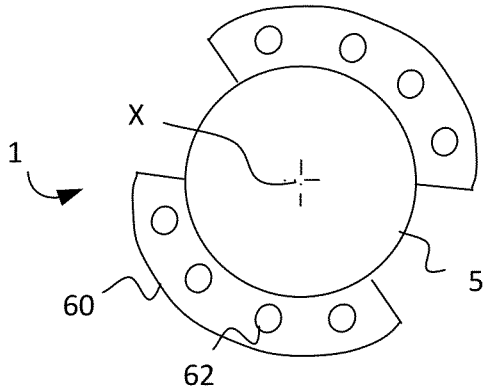

FIG. 9*b* illustrates in a view from above a top anchor unit 5 of an explosive material charging device 1 according to a further example. The explosive material charging device 1 comprises a radially outward extending resilient ring-shaped and discontinuously shaped rim 60 extending around the centre axis and around the periphery of the top anchor unit 5. The ring-shaped and discontinuously shaped rim 60 comprises through holes 62, through which water can flow for avoiding water pressure acting upon the explosive material charging device 1. The ring-shaped and discontinuously shaped rim 60 is configured to engage the borehole wall for holding the top anchor unit in position in the borehole.

Figure 10:
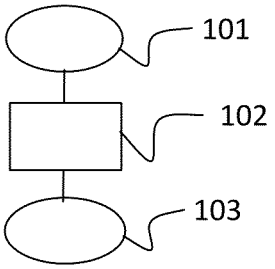
FIG. 10 illustrates a flowchart showing an exemplary method of positioning an explosive material charging device in a borehole.

FIG. 10 illustrates a flowchart showing an exemplary method of positioning an explosive material charging device 1 in a borehole by means of an explosive material charging device 1 that comprises; a top anchor unit and a bottom anchor unit configured to engage the borehole wall, an expandable tube member arranged between the top anchor unit and the bottom anchor unit and configured to be charged with explosive material, the bottom anchor unit comprises a backflow prevention valve device configured to prevent the explosive material to flow out from the expandable tube member, wherein the backflow prevention valve device is openable for permitting a charging hose to enter the expandable tube member for reaching the interior of the top anchor unit, the explosive material charging device comprises a detonator unit support configured to carry a detonator unit.

The method comprises a first step 101 starting the method. A second step 102 shows the performance of the method. A third step 103 comprises stopping the method.

The second step 102 may comprise; providing the explosive material charging device 1, wherein the expandable tube member is held in compressed state by means of a holding member; mounting the detonator unit to the detonator unit support; inserting the charging hose into the interior of the expandable tube member via the backflow prevention valve device; moving the charging hose until it abuts an abutment surface of the interior of the top anchor unit; releasing the holding member so that the expandable tube member is free to expand; pushing the top anchor unit in the borehole by means of the charging hose abutting the abutment surface, wherein the force of friction between the bottom anchor and the borehole provides longitudinal expansion of the expandable tube member; stop pushing the top anchor unit wherein the explosive material charging device 1 is in desired position in the borehole; discharging the explosive material into the expanded expandable tube member by means of the charging hose; removing the charging hose from the expandable tube member.

Figure 11:
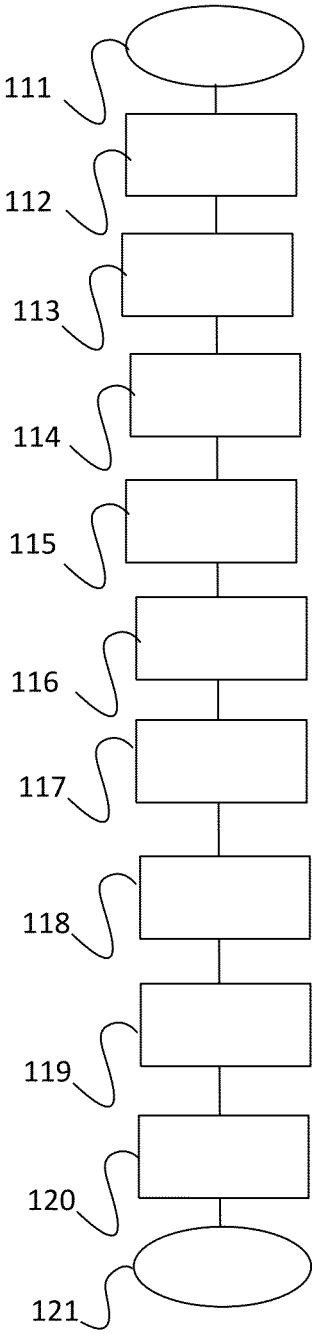
FIG. 11 illustrates a flowchart showing an exemplary method of positioning an explosive material charging device in a borehole.

FIG. 11 illustrates a flowchart showing an exemplary method of positioning an explosive material charging device 1 in a borehole by means of an explosive material charging device 1. The method comprises a first step 111 starting the method. A second step 112 comprises that a second explosive material charging device is provided, wherein an expandable tube member is held in compressed state between a second top anchor unit and a second bottom anchor unit by means of a second holding member. A third step 113 comprises the step of mounting a second detonator unit to a second detonator unit support of the second explosive material charging device. A fourth step 114 comprises inserting the charging hose into the interior of the second expandable tube member via a second backflow prevention valve device of the second bottom anchor unit. A fifth step 115 comprises moving the charging hose until it abuts a second abutment surface of the interior of the second top anchor unit. A sixth step 116 comprises releasing the second holding member so that the second expandable tube member is free to expand. A seventh step 117 comprises pushing the second top anchor unit in the borehole by means of the charging hose abutting the second abutment surface, wherein the force of friction between the second bottom anchor and the second borehole provides longitudinal expansion of the second expandable tube member. An eight step 118 comprises stop pushing the second top anchor unit when the second explosive material charging device is in desired position in the borehole and/or abuts an already charged first explosive material charging device) above the second explosive material charging device. A ninth step 119 comprises discharging the explosive material into the second expanded expandable tube member by means of the charging hose. A tenth step 120 comprise removing the charging hose from the second expandable tube member. An eleventh step 121 comprises stopping the method.

This procedure may be repeated with insertion of further explosive material charging devices in the borehole depending upon the length of the borehole.

Figure 12:
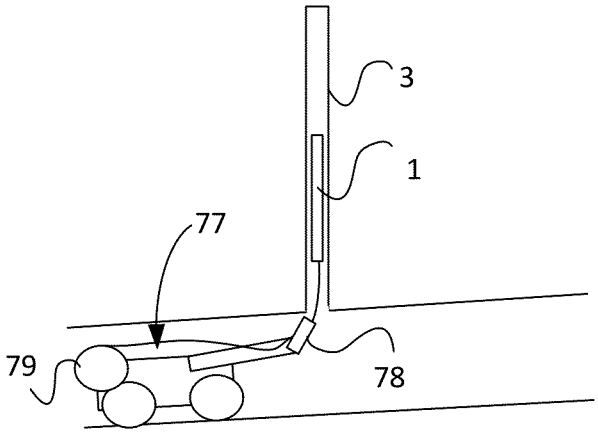
FIG. 12 illustrates an explosive material charging vehicle configured to perform an exemplary method of positioning an explosive material charging device in a borehole.

FIG. 12 illustrates an explosive material charging vehicle 77 configured to perform an exemplary method of explosive material charging in a borehole 3. The explosive material charging vehicle 77 comprises a robotic arm 78 and a charging hose feeder 79, which are coupled to a control circuitry (not shown, reference 50, see FIG. 13) of the explosive material charging vehicle 77. The control circuitry is configured to control the exemplary method or methods as disclosed herein. The control circuitry comprises a data medium, configured for storing a data program, configured for controlling the operation of the explosive material charging device 1 operated by the explosive material charging vehicle 77. The data medium comprises a program code stored on the data medium, which program code is readable on the control circuitry for performing the exemplary method steps herein described or other examples achieved by many possibilities to modifications, or combinations of the described examples apparent to the person with ordinary skill in the art without departing from the basic idea.

Figure 13:
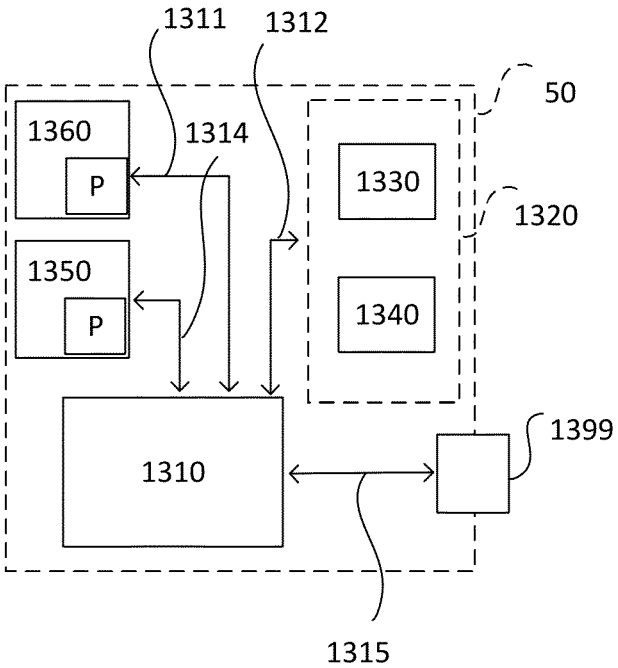
FIG. 13 illustrates a control circuitry adapted to operate an explosive material charging vehicle configured to perform an exemplary method of positioning an explosive material charging device in a borehole.

FIG. 13 illustrates a control circuitry 50 adapted to operate an explosive material charging vehicle (e.g. shown in FIG. 12) configured to perform an exemplary method of explosive material charging in a borehole by means of an explosive material charging device 1. The control circuitry 50 is coupled to an actuator arrangement (not shown) of a robotic arm (not shown) of the explosive material charging vehicle. The control circuitry 50 is configured to manage and operate the explosive material charging in a borehole by means of the explosive material charging device 1. The explosive material charging device comprises; a top anchor unit and a bottom anchor unit each configured to engage the borehole wall, an expandable tube member arranged between the top anchor unit and the bottom anchor unit and configured to be charged with explosive material, the bottom anchor unit comprises a backflow prevention valve device configured to prevent the explosive material to flow out from the expandable tube member, wherein the backflow prevention valve device is openable for permitting a charging hose to enter the expandable tube member for reaching the interior of the top anchor unit. The exemplary method may comprise; providing the explosive material charging device, wherein the expandable tube member is held in compressed state by means of a holding member; mounting the detonator unit to the detonator unit support; inserting the charging hose into the interior of the expandable tube member via the backflow prevention valve device; moving the charging hose until it abuts an abutment surface of the interior of the top anchor unit; releasing the holding member so that the expandable tube member is free to expand; pushing the top anchor unit in the borehole by means of the charging hose abutting the abutment surface, wherein the force of friction between the bottom anchor and the borehole provides longitudinal expansion of the expandable tube member; stop pushing the top anchor unit wherein the explosive material charging device is in desired position in the borehole; discharging the explosive material into the expanded expandable tube member by means of the charging hose; removing the charging hose from the expandable tube member.

The control circuitry 50 may also be configured for manoeuvring the explosive material charging vehicle 77 (see FIG. 12) in the crosscut of the mine (not shown).

The control circuitry 50 may comprise a computer and a non-volatile memory NVM 1320, which is a computer memory that can retain stored information even when the computer is not powered.

The control circuitry 50 further comprises a processing unit 1310 and a read/write memory 1350. The NVM 1320 comprises a first memory unit 1330. A computer program (which can be of any type suitable for any operational data) is stored in the first memory unit 1330 for controlling the functionality of the control circuitry 5. Furthermore, the control circuitry 50 comprises a bus controller (not shown), a serial communication unit (not shown) providing a physical interface, through which information transfers separately in two directions.

The control circuitry 50 may comprise any suitable type of I/O module (not shown) providing input/output signal transfer, an A/D converter (not shown) for converting continuously varying signals from a sensor arrangement (not shown) of the control circuitry 50 configured to determine the actual position of the robotic arm and the charging hose. The control circuitry 50 is configured to, from received control signals, define actual positions of the robotic arm and operation of the explosive material charging vehicle into binary code suitable for the computer, and from other operational data.

The control circuitry 50 also comprises an input/output unit (not shown) for adaptation to time and date. The control circuitry 50 comprises an event counter (not shown) for counting the number of event multiples that occur from independent events in operation of the explosive material charging vehicle.

Furthermore, the control circuitry 50 includes interrupt units (not shown) associated with the computer for providing a multi-tasking performance and real time computing for semi-automatically and/or autonomous maneuvering the explosive material charging vehicle. The NVM 1320 also includes a second memory unit 1340 for external sensor check of the sensor arrangement.

A data medium for storing a program P may comprise program routines for automatically adapting the maneuvering of the explosive material charging vehicle in accordance with operational data of co-operative explosive material charging vehicles (not shown).

The data medium for storing the program P comprises a program code stored on a medium, which is readable on the computer, for causing the control circuitry 50 to perform the method and/or method steps described herein.

The program P further may be stored in a separate memory 1360 and/or in the read/write memory 1350. The program P, in this embodiment, is stored in executable or compressed data format.

It is to be understood that when the processing unit 1310 is described to execute a specific function that involves that the processing unit 1310 may execute a certain part of the program stored in the separate memory 1360 or a certain part of the program stored in the read/write memory 1350. The processing unit 1310 is associated with a data port 999 for communication via a first data bus 1315 able to be coupled to the robotic arm and the charging hose feeder 79 for performing said method steps.

The non-volatile memory NVM 1320 is adapted for communication with the processing unit 1310 via a second data bus 1312. The separate memory 1360 is adapted for communication with the processing unit 610 via a third data bus 1311. The read/write memory 1350 is adapted to communicate with the processing unit 1310 via a fourth data bus 1314. After that the received data is temporary stored, the processing unit 1310 will be ready to execute the program code, according to the above-mentioned method.

Preferably, the signals (received by the data port 999) comprise information about operational status of the explosive material charging vehicle. The received signals at the data port 999 can be used by the control circuitry 50 for controlling and monitoring automatic calibration of the sensor device 1.

Information and data may be manually fed, by an operator, to the control circuitry via a suitable communication device, such as a computer display or a touchscreen.

The method can also partially be executed by the control circuitry 50 by means of the processing unit 1310, which processing unit 1310 runs the program P being stored in the separate memory 1360 or the read/write memory 1350. When the control circuitry 50 runs the program P, at least one of the exemplary methods disclosed herein will be executed.

Alternatively, the charging hose in motion is configured to open the openable cover device whilst a stopping arrangement (not shown) of the robotic arm stops the main body.

The present invention is of course not in any way restricted to the preferred embodiments described above, but many possibilities to modifications, or combinations of the described embodiments thereof should be apparent to a person with ordinary skill in the art without departing from the basic idea of the invention as defined in the appended claims.

What is claimed is:

1. An explosive material charging device configured to charge an explosive material in a borehole, the explosive material charging device comprising:

a charging hose comprising a nozzle;

an anchoring unit configured to engage with a borehole wall;

an expandable tube member comprising a top portion and a bottom portion, the expandable tube member extending between the top portion and the bottom portion, the expandable tube member configured to expand in a longitudinal orientation responsive to a force of friction between the anchoring unit and the borehole wall as the nozzle of the charging hose pushes the expandable tube member in the borehole; and a backflow prevention valve device comprising a flap member and configured to inhibit the explosive material to flow out from the bottom portion of the expandable tube member, the backflow prevention valve device openable for permitting the charging hose to enter the expandable tube member for reaching the top portion of the expandable tube member, the backflow prevention valve device configured to close the flap member subsequent to the nozzle of the charging hose being withdrawn from the backflow prevention valve device.

2. The explosive material charging device of claim 1, further comprising a holding member configured to hold the expandable tube member in a compressed state prior to inserting the charging hose into an interior of the expandable tube member.

3. The explosive material charging device of claim 1, wherein the flap member is spring biased to its closed state.

4. The explosive material charging device of claim 1, wherein the anchoring unit comprises a bottom anchor unit and a top anchor unit.

5. The explosive material charging device of claim 4, wherein the bottom anchor unit and/or the top anchor unit comprise a radially outward extending resilient teeth shaped flap.

6. The explosive material charging device of claim 4, wherein the nozzle of the charging hose is configured to abut an abutment surface of the top anchor unit for pushing the top anchor unit in the borehole.

7. The explosive material charging device of claim 4, wherein the bottom anchor unit comprises a detonator unit support configured to carry a detonator unit.

8. The explosive material charging device of claim 4, wherein the top anchor unit is above the bottom anchor unit when the explosive material charging device is positioned in a borehole.

9. The explosive material charging device of claim 1, wherein motion of the charging hose in the borehole is stopped when the expandable tube member is expanded, and the explosive material charging device has been moved into a desired position in the borehole.

10. The explosive material charging device of claim 1, wherein the expandable tube member is configured to isolate the explosive material from water in the borehole.

11. The explosive material charging device of claim 1, wherein the charging hose is moved by an electrical motor of a mining truck.

12. The explosive material charging device of claim 1, wherein an explosive material discharge pump coupled to the charging hose is configured to feed the explosive material to the nozzle of the charging hose.

13. A method of positioning an explosive material charging device in a borehole, the method comprising:

providing the explosive material charging device, the explosive material charging device comprising:

a charging hose comprising a nozzle;

an anchoring unit configured to engage with a borehole wall;

an expandable tube member comprising a top portion and a bottom portion, the expandable tube member extending between the top portion and the bottom portion; and a backflow prevention valve device comprising a flap member and configured to inhibit an explosive material to flow out from the bottom portion of the expandable tube member, the backflow prevention valve device openable for permitting the charging hose to enter the expandable tube member for reaching the top portion of the expandable tube member, the backflow prevention valve device configured to close the flap member subsequent to the nozzle of the charging hose being withdrawn from the backflow prevention valve device;

mounting a detonator unit to a detonator unit support;

inserting the charging hose into an interior of the expandable tube member via the backflow prevention valve device;

moving the charging hose to the top portion of the expandable tube member;

pushing the expandable tube member in the borehole by the charging hose, wherein at least a force of friction between the anchoring unit and the borehole provides longitudinal expansion of the expandable tube member as the charging hose pushes the expandable tube member in the borehole;

stopping pushing the expandable tube member when the explosive material charging device is in a desired position in the borehole;

discharging the explosive material into the expandable tube member by the charging hose; and removing the charging hose from the expandable tube member.

14. The method of claim 13, wherein the anchoring unit of the explosive material charging device comprises a bottom anchor unit and a top anchor unit.

15. The method of claim 14, wherein the bottom anchor unit and/or the top anchor unit comprise a radially outward extending resilient teeth shaped flap.

16. The method of claim 13, further comprising releasing a holding member so that the expandable tube member is free to expand.

17. The method of claim 13, where removing the charging hose comprises withdrawing the charging hose from the backflow prevention valve device.

* * * * *